US006032791A

United States Patent [19]

Gresh, Jr. et al.

[11] Patent Number: 6,032,791

[45] Date of Patent: Mar. 7, 2000

[54] CONTAINER CARRIER ADAPTED FOR USE WITH ADHESIVE HANDLE

[75] Inventors: Philip M. Gresh, Jr., Naperville; Richard D. Hroch, Bridgeview, both of Ill.

[73] Assignee: Illinois Tool Works Inc., Glenview, Ill.

[21] Appl. No.: 09/173,812

[22] Filed: Oct. 16, 1998

[51] Int. Cl.[7] ..... B65D 65/00

[52] U.S. Cl. ..... 206/150; 206/428

[58] Field of Search ..... 206/141, 142, 206/143, 150, 151, 162, 427, 428, 199; 294/87.2

[56] References Cited

U.S. PATENT DOCUMENTS

| | | | |
|---|---|---|---|
| 2,361,926 | 11/1944 | Brogden | 206/428 |
| 2,680,039 | 6/1954 | Burge . | |
| 3,114,496 | 12/1963 | Wilcox | 206/428 |
| 3,186,544 | 6/1965 | Curry et al. . | |
| 4,296,861 | 10/1981 | Barrash | 206/428 |
| 4,776,622 | 10/1988 | Ross | 206/150 |
| 4,782,955 | 11/1988 | Weaver et al. | 206/150 |
| 5,188,413 | 2/1993 | Nathan | 206/151 |
| 5,425,446 | 6/1995 | Weaver et al. . | |
| 5,437,364 | 8/1995 | Broskow . | |
| 5,452,794 | 9/1995 | DiVietro . | |
| 5,538,130 | 7/1996 | Harrelson | 206/428 |
| 5,570,787 | 11/1996 | Danovaro et al. . | |

*Primary Examiner*—Paul T. Sewell
*Assistant Examiner*—Luan K. Bui
*Attorney, Agent, or Firm*—Pauley Petersen Kinne & Fejer

[57] ABSTRACT

This invention relates to a package of a plurality of containers unitized with a flexible carrier and carried using a handle having adhesive ends. The carrier includes a flexible planar sheet having a plurality of container receiving openings arranged in at least one longitudinal row. A handle attachment area is integrally formed with the planar sheet and engages with the adhesive end of the handle. The resulting package is portable using the handle attached between the handle attachment areas of the carrier.

11 Claims, 3 Drawing Sheets

CONTAINER CARRIER ADAPTED FOR USE WITH ADHESIVE HANDLE

BACKGROUND OF THE INVENTION

1. Field of the Invention

This invention relates to a carrier that unitizes a plurality of containers and is carried using a handle having adhesive ends connected with respect to a handle attachment area of the carrier.

2. Description of Prior Art

Conventional container carriers are often used to unitize a plurality of similarly sized containers, such as cans, bottles, jars and boxes, although other packages or containers may be unitized. One such conventional container carrier is the plastic ring carrier which engages with a plurality of like-sized containers to create a package. Several current designs of the plastic ring carrier engage with containers around a middle portion of the containers. The positioning of the ring carrier in the middle portion of the container together with packaging of heavier and larger containers create difficulties in carrying the resulting packages.

One solution to this portability issue is Weaver et al., U.S. Pat. No. 5,425,446. The Weaver patent teaches a two-piece package including a carrier positioned around a middle portion of the containers and a top panel overlying a top portion of the containers. The top panel taught by the Weaver patent includes finger holes for carrying the package.

Broskow, U.S. Pat. No. 5,437,364, also teaches a carrier for engagement around a middle portion of containers, the carrier having a plurality of handle receiving slots. A separate handle component having tabs corresponding with the handle receiving slots is then engaged with the carrier.

Finally, Curry et al., U.S. Pat. No. 3,186,544, teaches a carrier for engagement around a middle portion of container. The carrier taught by the Curry et al. patent includes integral handle straps that extend between center portions of the carrier.

SUMMARY OF THE INVENTION

It is one object of this invention to provide a carrier that unitizes a plurality of containers into a tight, solid and easily portable package.

It is another object of this invention to provide a container package having an accessible and convenient handle.

It is still another object of this invention to provide a container package that may be retroactively fitted with a convenient handle for carrying the package.

It is yet another object of this invention to provide a carrier for use in connection with a handle having adhesive ends.

A carrier for carrying a plurality of containers in a unitized package is constructed from a flexible, resilient material such as plastic forming a plastic sheet. The planar sheet is formed with a plurality of container receiving openings arranged in at least one longitudinal row.

The planar sheet additionally comprises a handle attachment area integral with the planar sheet. The handle attachment area is adapted to engage with a corresponding portion of a handle.

The handle is preferably a planar strip of polymeric or other flexible material. The handle also comprises adhesive ends having a removable backing positioned at opposite ends of the handle. After the removable backing is removed, the adhesive end is engaged with the handle attachment area of the carrier.

The handle attachment area may comprise a tab extending across at least a portion of a container receiving opening. The tab preferably extends entirely across the container receiving opening and connects with the planar sheet through a severable end of the tab. Alternatively, two tabs extend from opposite sides of a container receiving opening and are severably connected to each other through tab ends.

A package containing a plurality of containers is assembled by inserting a container into each container receiving opening resulting in stretching engagement of the container receiving opening with the container. As containers are inserted into the container receiving openings having tabs, the tabs preferably are ruptured or severed from their respective connections and thereupon extend in a perpendicular position with respect to the planar sheet. Handle is then applied to each tab by adhering at least one adhesive end of the handle to each tab. The package is then carried using a handle strip that extends between or over containers.

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

Figure 3:
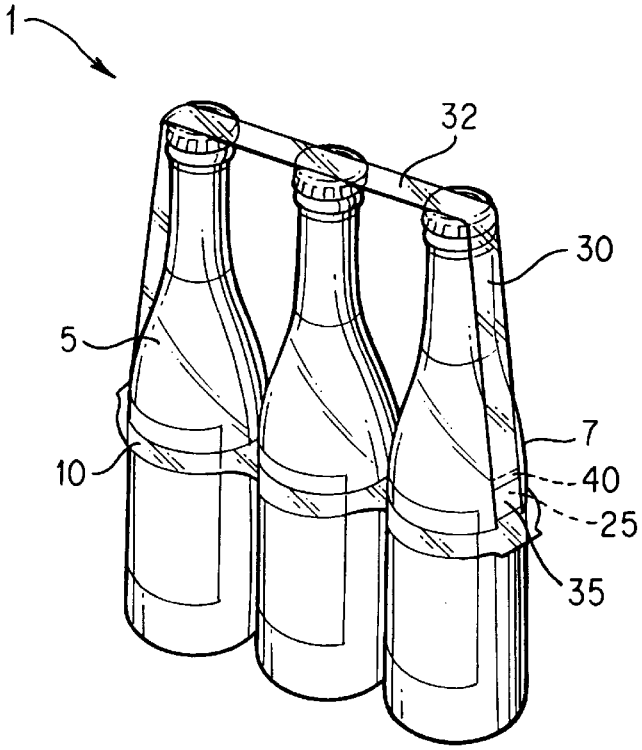
FIG. 3 is a perspective view of a package of containers using the carrier shown in FIG. 1 and the handle shown in FIG. 2.
Figure 4:
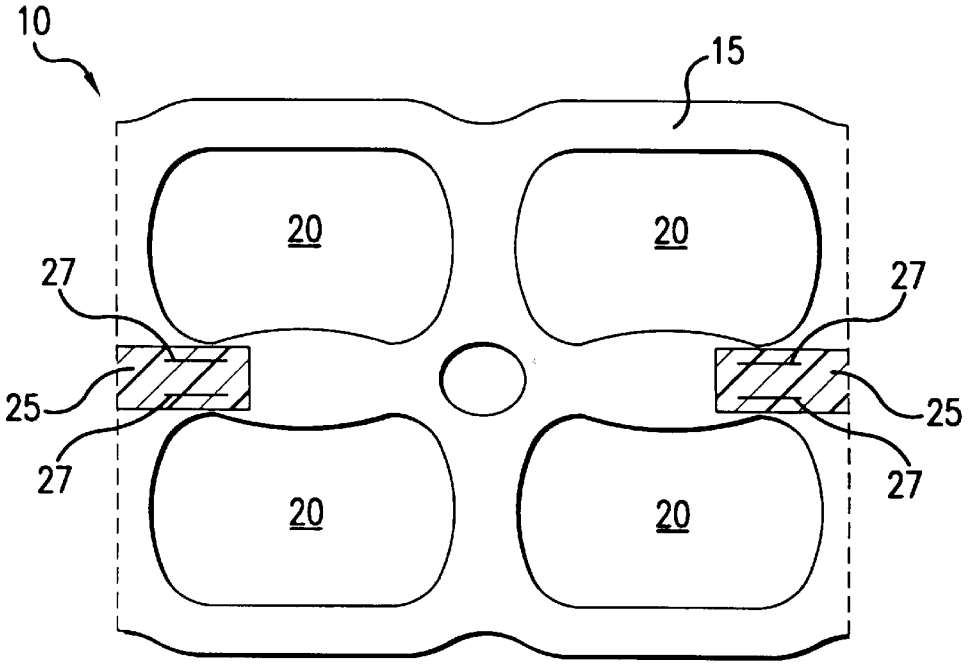
FIG. 4 is a top view of a carrier according to another preferred embodiment of this invention.
Figure 5:
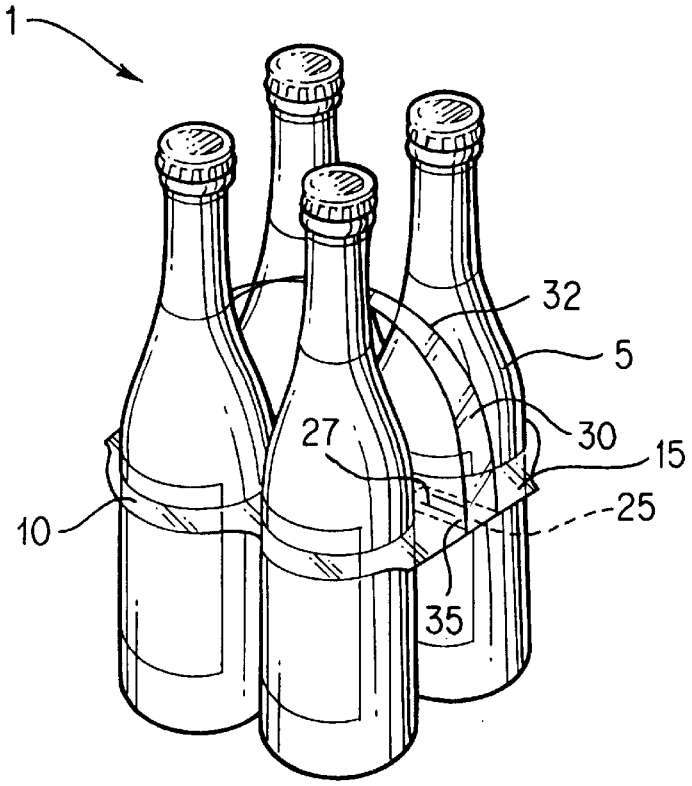
FIG. 5 is a perspective view of a package of containers using the carrier shown in FIG. 4 and the handle shown in FIG. 2.

FIGS. 1 and 3–8 show carrier 10 for carrying a plurality of containers 5. Containers 5 shown in FIGS. 3 and 5 are preferably elongated containers such as bottles, although cans, jars or other containers may be used in connection with carrier 10. Containers 5 are preferably like-sized within a single carrier 10.

Carrier 10 unitizes a plurality of containers 5 to create package 1, such as package 1 shown in FIGS. 3 and 5. Carrier 10 comprises planar sheet 15 preferably constructed from a flexible, resilient material such as plastic. In one preferred embodiment of this invention, planar sheet 15 is made from low density polyethylene.

Figure 1:
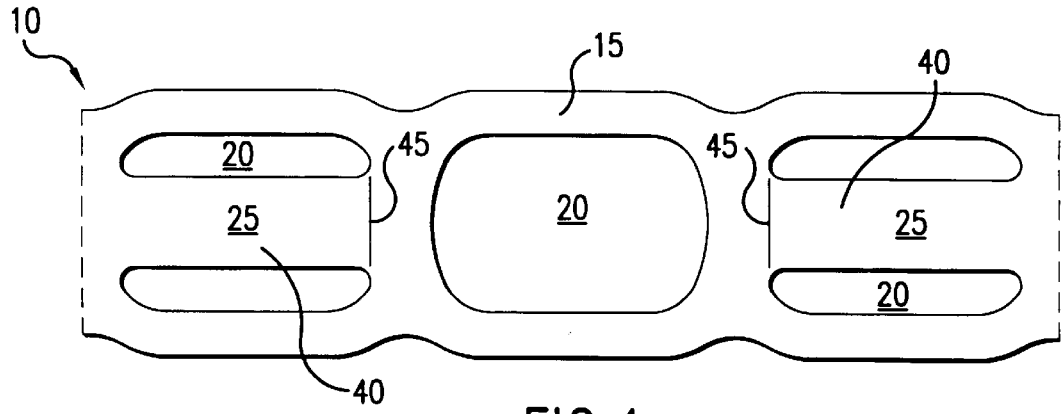
FIG. 1 is a top view of a carrier according to one preferred embodiment of this invention.
Figure 6:
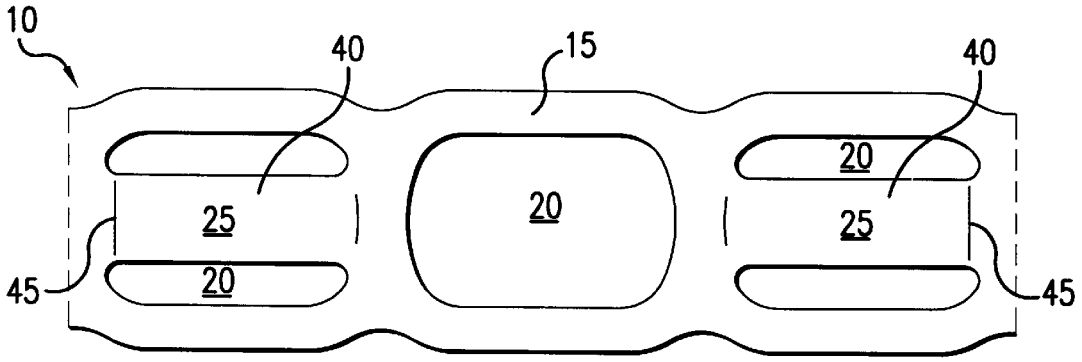
FIG. 6 is a top view of a carrier according to another preferred embodiment of this invention.
Figure 7:
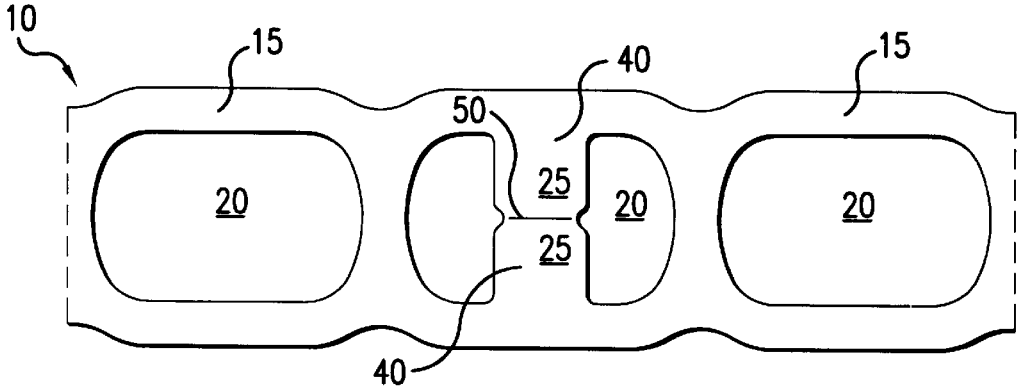
FIG. 7 is a top view of a carrier according to another preferred embodiment of this invention.

Planar sheet 15 of material is preferably cut, using means known to those skilled in the art, such as a stamping die, to form a plurality of container receiving openings 20 in planar sheet 15. Preferably, three or more container receiving openings 20 are formed in planar sheet 15 in at least one longitudinal row and, in one preferred embodiment of this invention, a plurality of transverse ranks. Preferably, container receiving openings 20 are configured in one row of three container receiving openings as shown in FIGS. 1, 6 and 7. Planar sheet 15 may include other configurations of container receiving openings 20 depending on the size of package 1 desired.

Planar sheet 15 further comprises handle attachment area 25 integral with planar sheet 15. Handle attachment area 25 is preferably a planar surface of suitable width and length to accommodate a corresponding width and length of handle 30.

Figure 2:
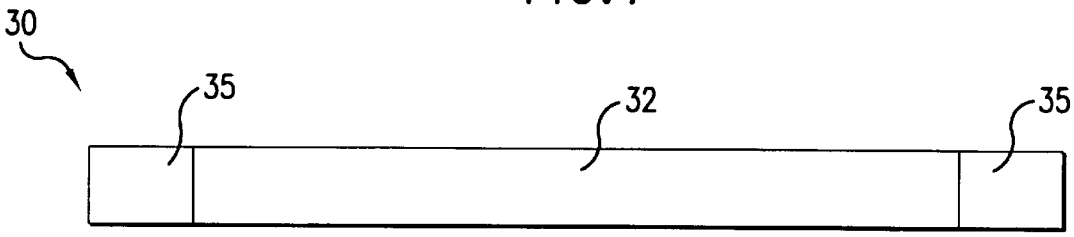
FIG. 2 is a top view of a handle according to one preferred embodiment of this invention.

Handle 30, shown in FIG. 2, is preferably manufactured separately from carrier 10 and comprises an aftermarket, commercially available apparatus such as the Carry Handle™ produced by 3M Corporation of Minn., Minnesota. Handle 30 preferably comprises a planar strip of polymeric or other flexible material. Handle 30 also preferably comprises adhesive end 35 positioned at opposite ends of handle 30. Adhesive end 35 preferably comprises a removable backing positioned over an adhesive coating. When the removable backing is removed from the adhesive end 35 then the adhesive coating is engaged with an appropriate engagement surface. In a preferred embodiment of this invention, the appropriate engagement surface comprises handle attachment area 25 of carrier 10. Handle 30, such as the preferred embodiment shown in FIG. 2, is preferably adaptable for use with each of the carriers 10 shown in FIGS. 1,4 and 6–8.

In one preferred embodiment of this invention, handle attachment area 25 comprises tab 40 extending across at least a portion of at least one of the container receiving openings 20. In a preferred embodiment of this invention shown in FIGS. 1 and 6, tab 40 extends entirely across at least one, and preferably two container receiving openings 20. Although not shown in the drawings, tab 40 may extend only partially across container receiving openings 20.

In a preferred embodiment of this invention shown in FIGS. 1 and 6, tab further comprises severable end 45 connected with respect to planar sheet 15. Severable end 45 is preferably perforated or otherwise weakened so that severable end 45 is detachable from the planar sheet 15.

In another preferred embodiment of this invention shown in FIG. 7, handle attachment area 25 comprises two tabs 40 extending from opposite sides of at least one of the container receiving openings 20. Preferably, the two tabs 40 each comprise tab end 50. As shown in FIG. 7, tab ends 50 are severably connected to each other with a perforation, slit or other severable connection.

In another preferred embodiment of this invention, handle attachment area 25 comprises bonding means for bonding with adhesive end 35 of handle 30. Bonding means 55 may comprise adhesive, epoxy, a surface having a different coefficient of friction than a surface of planar sheet 15 or any other means for bonding two surfaces known to those having ordinary skill in the art.

Regardless of a configuration of carrier 10, handle attachment area 25 is preferably positioned at two opposite sides of carrier 10. Handle attachment area 25 may be positioned at longitudinally opposite sides as shown in FIGS. 1, 4, 6 and 8 or may be positioned on laterally opposite sides as shown in FIG. 7. The position of handle attachment area 25 depends upon the configuration of carrier 10 and the relative stability of handle 30 on package 1.

Package 1 of a plurality of containers 5 is shown in FIGS. 3 and 5. Containers 5 are preferably inserted into each container receiving opening 20. Container receiving opening 20 preferably stretchingly engages with sidewall 7 of each container 5.

Upon insertion of each container 5 into container receiving openings 20 having tabs 40, such as those described above and shown in FIGS. 1, 6 and 7, tabs 40 preferably extends generally perpendicular, as shown in FIG. 3, with respect to planar sheet 15 and along sidewall 7 of container 5. In those embodiments of this invention wherein tab 40 is connected with respect to planar sheet 15, the action of inserting container 5 preferably results in detachment or rupture of severable end 45 with respect to planar sheet 15 or tab ends 50 with respect to each other.

When each container 5 is engaged within carrier 10, package 1 is preferably a tight, solid and unitized assembly of containers 5 and carrier 10. Handle 30 is thereupon applied by adhering at least one adhesive end 35 of handle 30 with handle attachment area 25, such as tab 40. Package 1 may then be carried using handle strip 32 that extends between or over containers 5.

Figure 8:
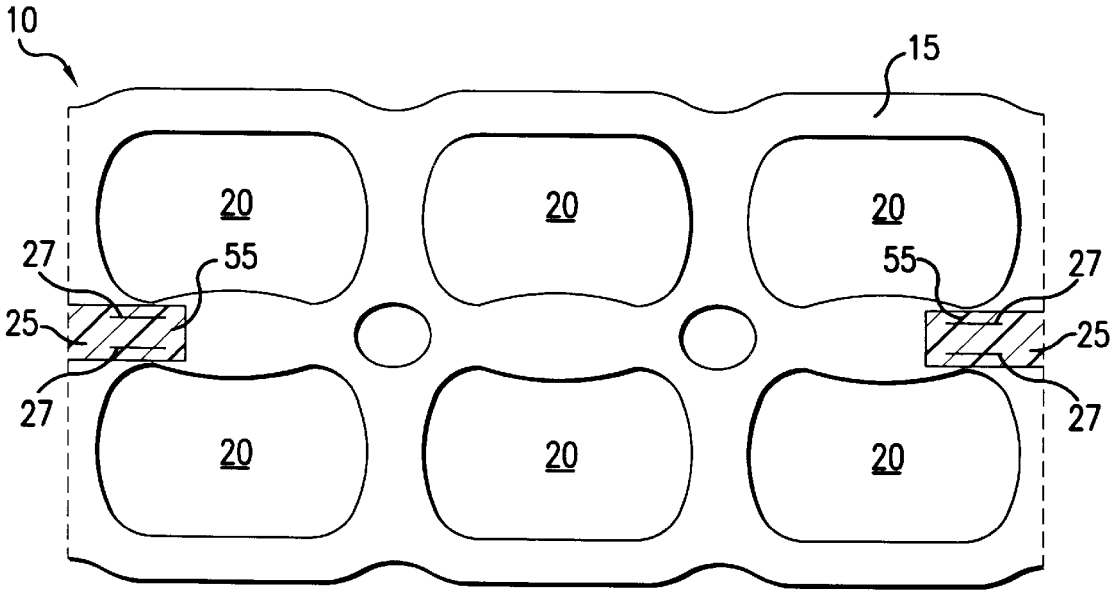
FIG. 8 is a top view of a carrier according to yet another preferred embodiment of this invention.

A potential effect of the attachment and use of handle 30 is the possibility of stretching container receiving openings 20 around sidewall 7 of container 5. Such stretching of container receiving openings 20 may result in a loosened engagement of container 5 with respect to container receiving opening 20. Therefore, in one preferred embodiment of this invention, handle attachment area 25 forms at least one slit 27, and preferably, as shown in FIGS. 4 and 8, two slits 27. Slits 27 are preferably positioned generally parallel to each other and parallel to a longitudinal length of container receiving opening 20. Slits 27 preferably urge planar sheet 15 within handle attachment area 25 into engagement with sidewall 7 of container 5 when handle 30 is lifted. Such engagement thus maintains containers 5 in a proper position within carrier 10.

While in the foregoing specification this invention has been described in relation to certain preferred embodiments thereof, and many details have been set forth for purpose of illustration, it will be apparent to those skilled in the art that carrier 10 is susceptible to additional embodiments and that certain of the details described herein can be varied considerably without departing from the basic principles of the invention.

We claim:

1. A carrier for carrying a plurality of containers, the carrier comprising:

a planar sheet of a plastic material having a plurality of container receiving openings arranged in at least one longitudinal row;

a handle attachment area integral with the planar sheet, the handle attachment area comprising a tab extending across at least a portion of at least one of the container receiving openings; and a handle having at least one adhesive end engaged with the handle attachment area.

2. The carrier of claim 1 wherein the tab extends across the at least one container receiving opening.

3. The carrier of claim 2 wherein the tab comprises a severable end detachable from the planar sheet.

4. The carrier of claim 1 wherein the handle attachment area comprises two tabs extending from opposite sides of at least one of the container receiving openings.

5. The carrier of claim 4 wherein the tabs comprise tab ends severably connected to each other.

6. The carrier of claim 1 wherein the handle attachment area comprises bonding means for bonding with the adhesive end of the handle.

7. A package of a plurality of containers, the package comprising:

a planar sheet of a plastic material having a plurality of container receiving openings arranged in at least one longitudinal row, each of the containers engaged with each of the plurality of container receiving openings;

a handle attachment area integrally formed with the planar sheet, the handle attachment area comprising a tab extending across at least a portion of at least one of the container receiving openings; and a handle having at least one adhesive end engaged with the handle attachment area.

8. The carrier of claim 7 wherein an end of the tab is detached upon insertion of a container.

9. The carrier of claim 8 wherein the tab extends generally perpendicular with respect to the planer sheet along a sidewall of a container.

10. The carrier of claim 7 wherein the handle attachment area comprises two tabs extending from opposite sides of at least one of the container receiving openings.

11. The carrier of claim 10 wherein the tabs are severed from each other upon insertion of a container of the containers.

* * * * *